United States Patent [19]

Kozuki

[11] Patent Number: 4,708,046

[45] Date of Patent: Nov. 24, 1987

[54] ELECTRONIC MUSICAL INSTRUMENT EQUIPPED WITH MEMORIZED RANDOMLY MODIFIABLE ACCOMPANIMENT PATTERNS

[75] Inventor: Koichi Kozuki, Hamamatsu, Japan

[73] Assignee: Nippon Gakki Seizo Kabushiki Kaisha, Shizuoka, Japan

[21] Appl. No.: 945,843

[22] Filed: Dec. 23, 1986

[30] Foreign Application Priority Data

Dec. 27, 1985 [JP] Japan ..... 60-293944

[51] Int. Cl.[4] ..... G10H 1/36; G10H 7/00

[52] U.S. Cl. ..... 84/1.03; 84/1.28; 84/DIG. 12; 84/DIG. 22

[58] Field of Search ..... 84/1.01, 1.03, 1.28, 84/DIG. 12, DIG. 22

[56] References Cited

U.S. PATENT DOCUMENTS

| | | | |
|---|---|---|---|
| 4,158,978 | 6/1979 | Hiyoshi et al. | 84/1.03 |
| 4,214,500 | 7/1980 | Adachi et al. | 84/1.03 X |
| 4,307,644 | 12/1981 | Aoki | 84/1.03 |
| 4,399,731 | 8/1983 | Aoki | 84/1.03 |

*Primary Examiner*—Stanley J. Witkowski
*Attorney, Agent, or Firm*—Spensley Horn Jubas & Lubitz

[57] ABSTRACT

An electronic musical instrument comprises an accompaniment keyboard; a memory of a relatively small capacity storing a set of accompaniment data sequentially aligned and constituting accompaniment patterns; a read-out circuit to successively read out the accompaniment data from the memory at given clock pulse timings; a judging circuit to judge whether each accompaniment datum read out indicates a predetermined specific value; a random signal generator for generating, independently of the data-reading-out timings, random signals each differing in value with time; an accompaniment data determining circuit to determine the contents of each read-out accompaniment datum when the latter is judged to indicate the specific value in accordance with the signal randomly outputted just when a judgement is made; and a tone generation determining circuit to determine the generation of the accompaniment tone based on the key depression information coming from the accompaniment keyboard and also to function, when the read-out accompaniment datum does not indicate the specific value, to generate regular accompaniment pattern. The instrument performs automatic accompaniments on the read-out accompaniment patterns with random modification of a part of the pattern. Thus the automatic bass and chord accompaniment is realized in non-monotonous, variation-rich manner without a player's temporal manipulation.

2 Claims, 12 Drawing Figures

ELECTRONIC MUSICAL INSTRUMENT EQUIPPED WITH MEMORIZED RANDOMLY MODIFIABLE ACCOMPANIMENT PATTERNS

BACKGROUND OF THE INVENTION (a) Field of the Invention

The present invention relates to an electronic musical instrument equipped with an automatic accompaniment system, and more particularly it concerns a system capable of randomly modifying memorized automatic accompaniment patterns during the progression of play of any one of the accompaniment patterns as it is read out from the memory means, on an electronic musical instrument, thus providing variation-rich automatic accompaniment.

(b) Description of the Prior Art

Known automatic accompaniment devices for use in electronic musical instruments are arranged so that a large number of accompaniment data constituting accompaniment patterns such as chord patterns and bass patterns has been stored in advance in memory means, and that the generation of such accompaniment tones as chord tones and bass tones is realized based on the accompaniment determination data read out in succession from this memory means in accordance with the progression of performance, and based also on the key depression informations delivered from the accompaniment keyboard.

In such a known automatic accompaniment device as mentioned above, however, a number of accompaniment patterns have been preliminarily stored in memory means in such a manner as to correspond to various rhythm patterns in one accompaniment pattern versus one rhythm pattern fashion.

In order to obviate such a drawback of the prior art, there has been proposed in the past an arrangement designed so that several modified accompaniment patterns associated with a fundamental accompaniment pattern are stored in memory means, so that the user selects desired ones of the stored modified patterns by manipulating selection switches provided on the panel board of the instrument, and the accompaniment is now switched over to his desired modified pattern. In this known automatic accompaniment apparatus, however, there has been the inconvenience that, as the number of such modified patterns increases, the capacity of the memory means of accompaniment patterns also has to be increased accordingly.

SUMMARY OF THE INVENTION

It is, therefore, a primary object of the present invention to provide an electronic musical instrument equipped with an improved randomly modifiable automatic accompaniment system which makes it possible to perform automatic accompaniment rich in variation by the use of this system which features a relatively small memory capacity and does not require the user to manipulate the pattern selection switches provided on the panel board of the instrument each time the accompaniment pattern is to be altered.

DETAILED DESCRIPTION OF THE PREFERRED EMBODIMENT

Figure 2:
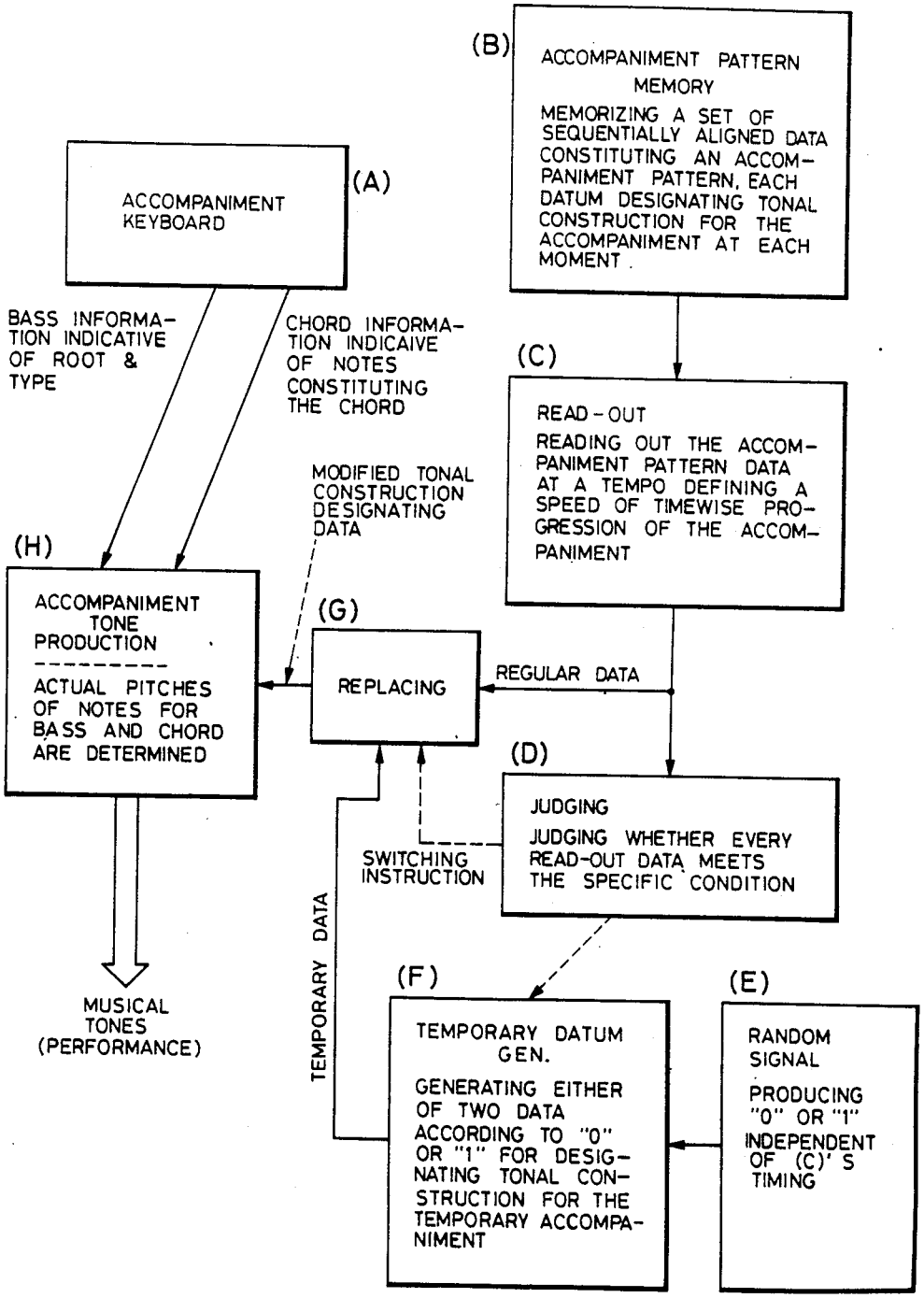
FIG. 2 is a block diagram which is a sort of flow chart to give a general idea of the functional interrelation of the constituent parts of the system of the present invention as to how any given accompaniment pattern is randomly modified during the progression of its performance.

The automatic accompaniment system which is equipped in an electronic musical instrument according to the present invention comprises: an accompaniment keyboard (which is conveniently referred to as (A) in FIG. 2, and same applies to the other constituent parts such as (B), (C), for the purpose of easy understanding of the mutual relationship and functional connections); memory means (B); reading-out means (C); judging means (D); random signal generating means (E); temporary datum generating means (F); replacing means (G); and accompaniment tone generating means (H).

The memory means (B) stores a group or set of sequentially aligned data constituting an accompaniment pattern, each constituting datum designating tonal construction for the accompaniment at each moment in the musical progression.

The reading-out means (C) reads out the accompaniment pattern data one after another in succession from the memory means (B) at a tempo defining a speed of timewise progression of the accompaniment.

The judging means (D) keeps on making judgment whether or not the accompaniment pattern data read out each time from the memory means meets a predetermined specific condition as to whether the accompaniment pattern now on play should be altered or not (this latter case takes place when the read-out data does not meet the specific condition). This judging means (D) serves as a switching means to give instruction to the replacing means (G) when no modification is required, so that regular data is supplied to the accompaniment tone producing means (H) which will be described later.

The random signal generating means (E) is comprised of, for example, a one-bit counter for counting clock pulses, and is arranged to produce signals having numerical values differing with time independently of the accompaniment pattern data reading-out timings, i.e. it continuously keeps generating numerical values "0" and "1" alternately.

The temporary datum generating means (F) may be or may not be associated with the judging means (D), but this temporary datum generator (F) is being supplied with random signals "0" or "1" from the random signal generator (E), and when the pattern data read out happens to meet the specific condition, it generates either one of the two pattern data according to the signal "0" or "1" received at that very moment from the random signal generating means (E), and the output of the generator (F) is supplied to the replacing means (G) so that the regular data is hereby modified or replaced and supplied to the accompaniment tone producing means (H) wherein actual pitches of notes (tonal construction) for bass and chord are determined based on these data and the informations coming from the accompaniment keyboard (A). The information from the accompaniment keyboard consists of bass information which is indicative of root and type of the chord for the bass tones, and of chord information indicative of notes which constitute the chord to be actually played.

Figure 1:
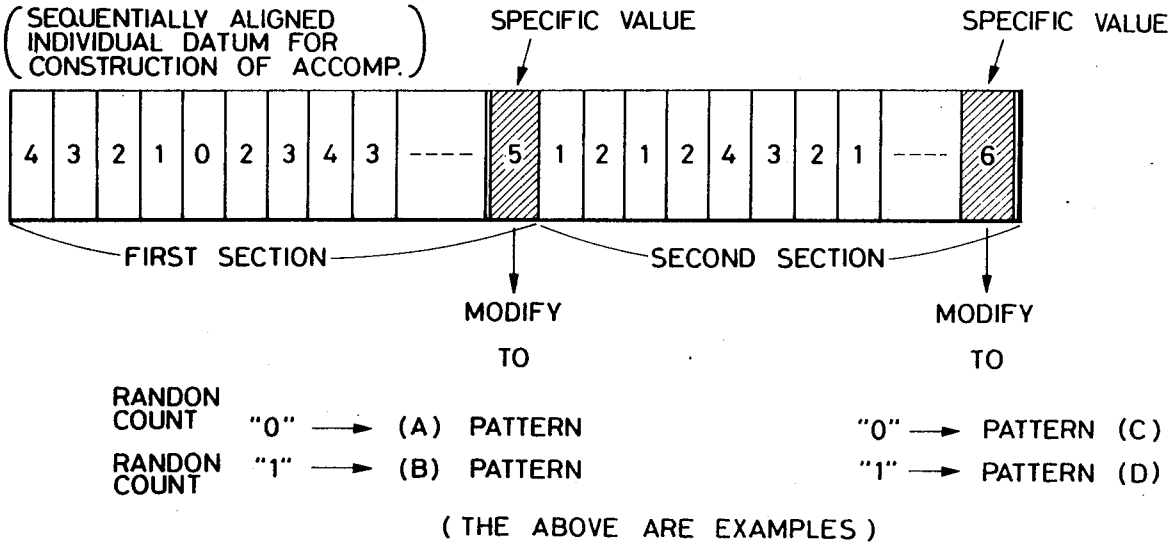
FIG. 1 is a diagram showing an example of memorized accompaniment pattern consisting of aligned two sets of individual datum which instructs the manner of construction of an accompaniment pattern.

Hereunder the function of the system according to the present invention will be described in further detail. By referring to FIG. 1, it will be noted that one set of aligned data, each datum of said data instructing the manner of constructing an accompaniment pattern, is divided into two sections, each section ending with a specific numerical value which differs from each other. These aligned individual data are stored in the memory means. As the reading-out of the thus stored accompaniment data goes on, the respective contents of the accompaniment determining data of the first section are judged one after another whether each meets the specific condition (to be a particular value), and if so the content of the accompaniment pattern datum at this specific moment is altered or modified in accordance with the output signal which may be either "0" or "1" delivered from the random signal generator into a modified accompaniment datum of either of predetermined two depending on the random signal. And, it should be noted here that, depending on the value of signal "0" or "1", the accompaniment pattern may be a first pattern or a second pattern, without requiring the user's manipulation. Thus, the actual accompaniment will present variation-rich accompaniment.

It should be noted here that those accompaniment pattern data corresponding to said first and second sections differ from those used in the conventional art only in that specific datum of each section end is preliminarily set so that their values are set in advance so as to meet the predetermined conditions. Thus, the memory means for storing accompaniment patterns used in the system of the present invention can have a relatively small capacity as compared to that of the prior art.

It should be noted here also that, in putting the present invention to practice, the number of the conditions which are subjected to judgment could be provided in a plural number, or arrangement may be provided so that the values of the accompaniment pattern data, i.e. accompaniment determination data, may be taken into consideration also when the contents of the accompaniment pattern data are determined, whereby the manner of modification of accompaniment patterns can be made much richer in variation.

Figure 3:
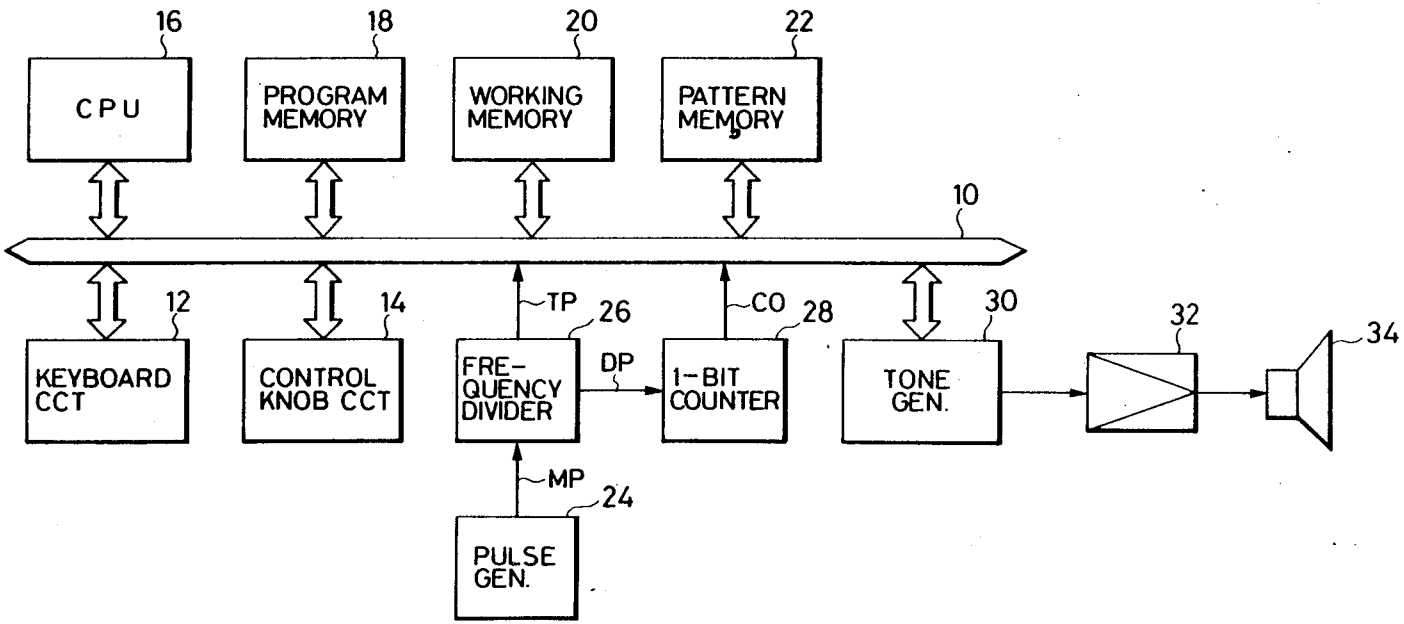
FIG. 3 is a block diagram showing the circuit arrangement of an electronic musical instrument embodying the present invention.

Let us now refer to FIG. 3. This Figure shows an example of circuit arrangement of an electronic musical instrument provided with an automatic accompaniment system according to the present invention. This electronic musical instrument is so constructed that the generation of melody tones, chord tones, bass tones, rhythm tones and so forth is controlled by a micro-computer.

CIRCUIT ARRANGEMENT OF ENTIRE INSTRUMENT (FIG. 3)

To a bus 10 are connected a keyboard circuit 12, a control knob circuit 14, a central processing unit (CPU) 16, a program memory 18, a working memory 20, a pattern memory 22, a frequency divider 26, a one-bit counter 28 and a tone generator 30.

The keyboard circuit 12 includes a keyboard having a keyboard region for melody performance and also a keyboard region for accompaniment performance. This whole keyboard circuit is arranged so that the key actuation informations are to be detected by successively and repetitively scanning those key switches corresponding respectively to a number of keys of this keyboard.

The control knob circuit 14 includes various control knobs of such as switches and volumes (variable resisters) which are both provided on the panel board of the instrument, and this circuit is arranged so that various control informations complying to the operations of control knobs can be detected.

The CPU 16 is intended to perform various kinds of processing for controlling or determining the generation of various music tones in accordance with the program stored in the program memory 18 which, in turn, is comprised of a ROM (Read Only Memory). The details of these various kinds of processing will be described later by referring to FIGS. 7 through 12.

The working memory 20 is formed with a RAM (Random Access Memory), and includes those working portions which will function as counters, resisters and like items respectively which are utilized in carrying out various kinds of processing undertaken by CPU 16. The details of these various kinds of functioning parts will be described later.

The pattern memory 22 is comprised of either a ROM or a RAM, and it stores a rhythm pattern, a chord pattern and a bass pattern for each kind of rhythm performance, and also stores a table of note degrees intended to determine or set bass note pitches. Among the contents stored in this pattern memory 22, those associated with the generation of chord tones and bass tones will be described later by referring to, for example, FIGS. 4 and 5.

The frequency divider 26 is assigned to divide the frequency of those master clock pulses MP which are generated by a pulse generator 24 to thereby generate tempo clock pulses TP and another clock pulses DP having a frequency of, for example, 10 kHz which is higher than the frequency of said tempo clock pulses. The tempo clock pulses TP are supplied to the bus 10, while the clock pulses DP are supplied to the one-bit counter 28.

Said one-bit counter 28 is intended to count the clock pulses DP, and its count output CO is delivered out to the bus 10.

The tone generator 30 includes a melody tone generator section $TG_M$, a chord tone generator section $TG_C$, a bass tone generator section $TG_B$ and a rhythm tone generator section $TG_R$. This tone generator 30 is arranged so that, under the control exerted by CPU 16, tone signals corresponding respectively to each tone generator section are generated. And, tone signals such as melody tone signals, chord tone signals, bass tone signals and rhythm tone signals which are delivered out from the tone generator 30 are supplied, via an output amplifier 32, to a loudspeaker 34, to be converted to sounds.

DETAILS OF THE WORKING MEMORY 20

Among those functional parts such as counters and registers which are included in the working memory 20, those associated with the generation of chord tones and bass tones are enumerated as follows.

(1) First tempo counter TCLA

This is assigned to count those tempo clock pulses TP delivered from the frequency divider 26. As an example, this counter assumes count values from "0" to "31", and this counter is reset to "0" at the timing at which the count becomes "32" (i.e. the end of one bar, i.e. measure).

(2) Second tempo counter TCLB

This counter is arranged so that, each time the first tempo counter TCLA assumes a count value of even number, this second tempo counter is set with a count value which is ½ of said even count value, and this counter assumes count values ranging from "0" to "15".

(3) Key code registers $KC_1 \sim KC_3$

These registers are buffer registers intended to store key code data for three (3) keys counted from the lowest note key among the plurality of depressed keys in the accompaniment key region. The values of the key code data are so determined as mentioned in the following Table 1 for each note name.

TABLE 1

| Note name: | $C_0$ | $C^{\#}_0$ | ... | $C_1$ | ... | $C_2$ | ... |
|---|---|---|---|---|---|---|---|
| Value: | 0 | 1 | ... | 12 | ... | 24 | ... |

(4) Count value register CNT

This is a register intended to set the count values of the one-bit counter 28. The setting of count values is performed at every fourth-note timing (i.e. at each time that the count value of TCLA becomes "8").

(5) Chord tone production registers $CH_1 \sim CH_3$

These are key code registers corresponding to the three (3) channels intended for the production of chord tones. Those key code data of said key code registers $KC_1 \sim KC_3$ are transferred to these registers $CH_1 \sim CH_3$, respectively, to be stored therein.

(6) Chord control data register CHDR

This is a register for storing the chord pattern constituting data, i,e. chord determination data, as they are read out from the pattern memory 22.

(7) Bass control data register BASR

This is a register for storing the bass pattern constituting data, i.e. bass determination data, as they are read out from the pattern memory 22.

(8) Bass tone production register BSNR

This is a register for storing the bass tone pitch determination data constituting a part of the bass determination data, or to store the bass tone pitch data formed based on the abovesaid bass tone pitch determination data.

(9) Root note register ROT

This is a register for storing the root note data indicative of the root note name having been detected based on a key depression done in the accompaniment kay region. The values of the root note data are so determined as to become "0", "1", . . . , "11" correspondingly to the twelve (12) note names: C, C#, . . . , B, respectively.

(10) Chord type register TYP

This is a register for storing the chord type data indicative of those chord types detected based on the key depression occurred in the accompaniment key region. The values of the chord types are predetermined so as to become "1", "2", "3" and "4" to correspond to the four (4) types of chords: major, minor, seventh and minor seventh, respectively.

(11) Address register ADR

This is a register for storing those address data intended to read the table of bass note degrees stored in the pattern memory 22.

Figure 4:
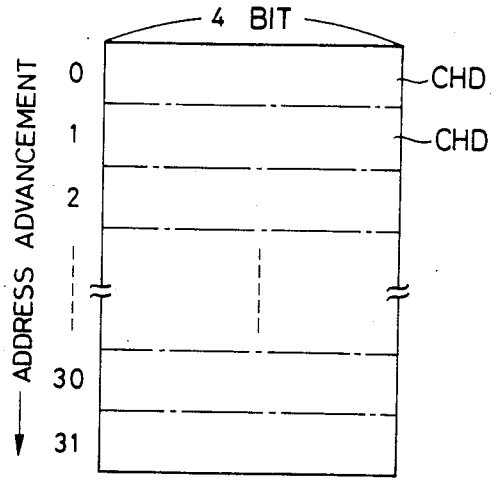
FIG. 4 is an example of the data format of a chord pattern.
Figure 5:
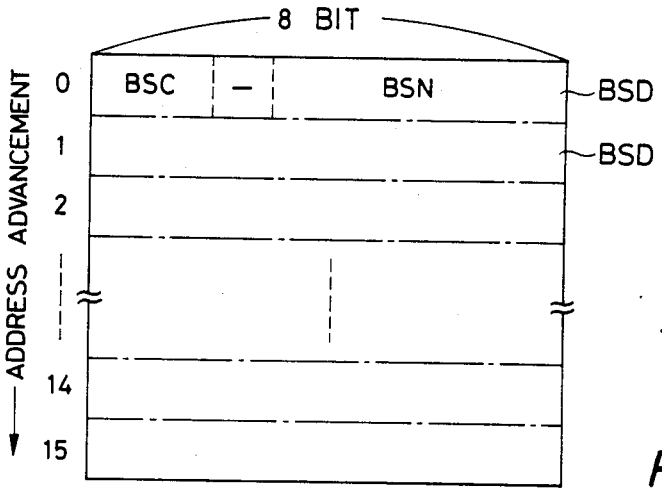
FIG. 5 is an example of the data format of a bass pattern.

DETAILS OF THE PATTERN MEMORY 22 (FIGS. 4 and 5)

As the memory sections associated with the generation of chord tones and bass tones in the pattern memory 22, there are provided chord patern memory section, bass pattern memory section and bass note degree memory section.

The chord pattern memory section stores a plurality of chord patterns corresponding to plural kinds of rhythms, respectively. Each chord pattern is constituted by a group of chord determination data CHD which are arranged in accordance with the progression of addresses corresponding to the count values "0"~"31" of the tempo counter TCLA.

Each chord determination data CHD in this embodiment is a 4-bit data, and assumes either one of the values "0"~"7". Here, the values "0"~"7" are such that, if the value is "0", it indicates that the three (3) tones of the chord are all to be sounded out jointly. If the value assumed is "1", the three tones of the chord are sounded out jointly by shifting up the pitch of the lowest tone among the three tones by one octave. If the value is "2", only the lowest tone among the three tones is sounded out. If the value is "7", all of the three tones are stopped of being sounded out. Thus, these values assumed by the respective chord determination data indicate mutually different contents of control. If should be noted here that if the value is either "5" or "6", however, this indicates that the contents of the chord determination data are to be set in random fashion in accordance with the count value indicated just then by the one-bit counter 28.

The bass pattern memory section stores a plurality of bass patterns corresponding to the plural kinds of rhythms, respectively. Each bass pattern, as shown in FIG. 5, is constituted by a group of bass determination data BSD which are arranged in accordance with the progression of addresses corresponding to the count values "0"~"15" of the tempo counter TCLB, respectively.

Each bass determination data BSD is comprised of 8-bit data. These data area arranged so that the most significant two bits represent the bass tone production determination data BSD, and the less significant five bits represent the bass tone pitch determination data BSN, and the remainder one bit signifies "not in use".

The bass tone sounding determination data BSC assumes a value "0"~"3". The value "0" indicates the cease of sounding of tones. If the value is "1", this indicates the continuation of sounding ("tie"), and if the value is "2", it indicates the alteration of the tone pitch ("slur"), and the value "3" indicates the commencement of sounding.

The bass tone pitch determination datum BSN indicates either one of the numbers "−16"~"+15" in accordance with the twos complement expression. Here, values "−5"~"+15" are indicative of bass note scale degrees, i.e. normalized pitches, based on root notes, while the symbol "minus" indicates that the note degree is one-octave lower than the root note, and the absolute values "5"~"15" without the symbols indicate the number of semitones counted from the root note, respectively. Also, "−16"~"−6" indicate that the contents of the determination data have to be set. Especially, "−16"~"7" indicate that the contents of the determination data require to be set in accordance with the count value of the one-bit counter 28.

The bass note degree table memory section is provided to set bass note degrees in accordance with the count value of the one-bit counter 28 when the bass tone pitch determination data BSN assumes either one of the values "−16"~"−9". This memory section stores such note scale degrees as shown by the term "stored values" in the following Table 2.

TABLE 2

| BSN value | ADR value | Stored value | Scale degree |
|---|---|---|---|
| −16 | 0 | 0 | 1 |
| | 1 | 7 | 5 |
| −15 | 2 | 7 | 5 |
| | 3 | −5 | 5 octave lower |
| −14 | 4 | 7 | 5 |
| | 5 | 12 | 1 octave higher |
| −13 | 6 | 10 | 7 |
| | 7 | 12 | 1 octave higher |
| −12 | 8 | 0 | 1 |
| | 9 | −5 | 5 octave lower |
| −11 | 10 | 7 | 5 |
| | 11 | 10 | 7 |
| −10 | 12 | 0 | 1 |
| | 13 | 4 | 3 |
| −9 | 14 | 4 | 3 |
| | 15 | 7 | 5 |

When the bass note degree table is to be read, an address data is first formed based on the bass tone pitch determination data BSN which assumes either one of the values "−16"~"−9" and also based on the count value of the one-bit counter 28, and this address data is stored in the address register ADR, and the tone degree data corresponding to the address data stored in said address register ADR is read out. Therefore, in Table 2, there are shown the stored values in association with the values of the bass tone pitch determination data BSN and also with the values of the address register ADR, and in addition those tone degrees corresponding to each stored value are shown in the form of the degree numbers.

As shown in Table 2, there are two stored values which can be read out for each BSN value. Which one of these two values is to be read out is determined in accordance with the count value indicated by the one-bit counter 28. In this instant embodiment, arrangement is provided so that, when the count value of the counter 28 shows "0", those stored values corresponding to the values "0", "2", "4", . . . , "14" of ADR are read out, while when the value of the counter 28 indicates "1", those stored values corresponding to values "1", "3", "5", . . . , "15" of ADR are read out. It should be noted here that the counter 28 assumes a count value of either "0" or "1" independently of the reading-out timing of the bass determination data BSD and changing with time. Therefore, even when the value of BSN indicates a same value, there will be the instance wherein the stored value which is read out could be same or different. Whereby, random setting of bass note degree is made faeasible.

Figure 6:
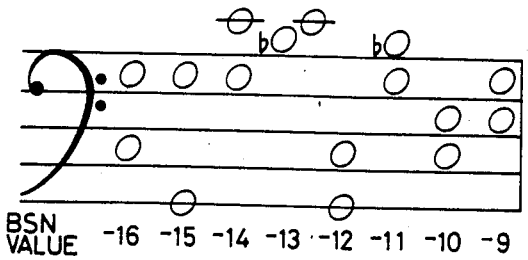
FIG. 6 is an illustration of an example showing the bass tones which can be sounded out for a random modification in case the root note is "C".

FIG. 6 shows exemplarily those randomly pronounceable bass tones for each BSN value in case the root note is set as C-note. For example, in case the BSN value indicates "−10", either the note $C_3$ or the note $E_3$ may be sounded out in random fashion.

MAIN ROUTINE (FIG. 7)

Figure 7:
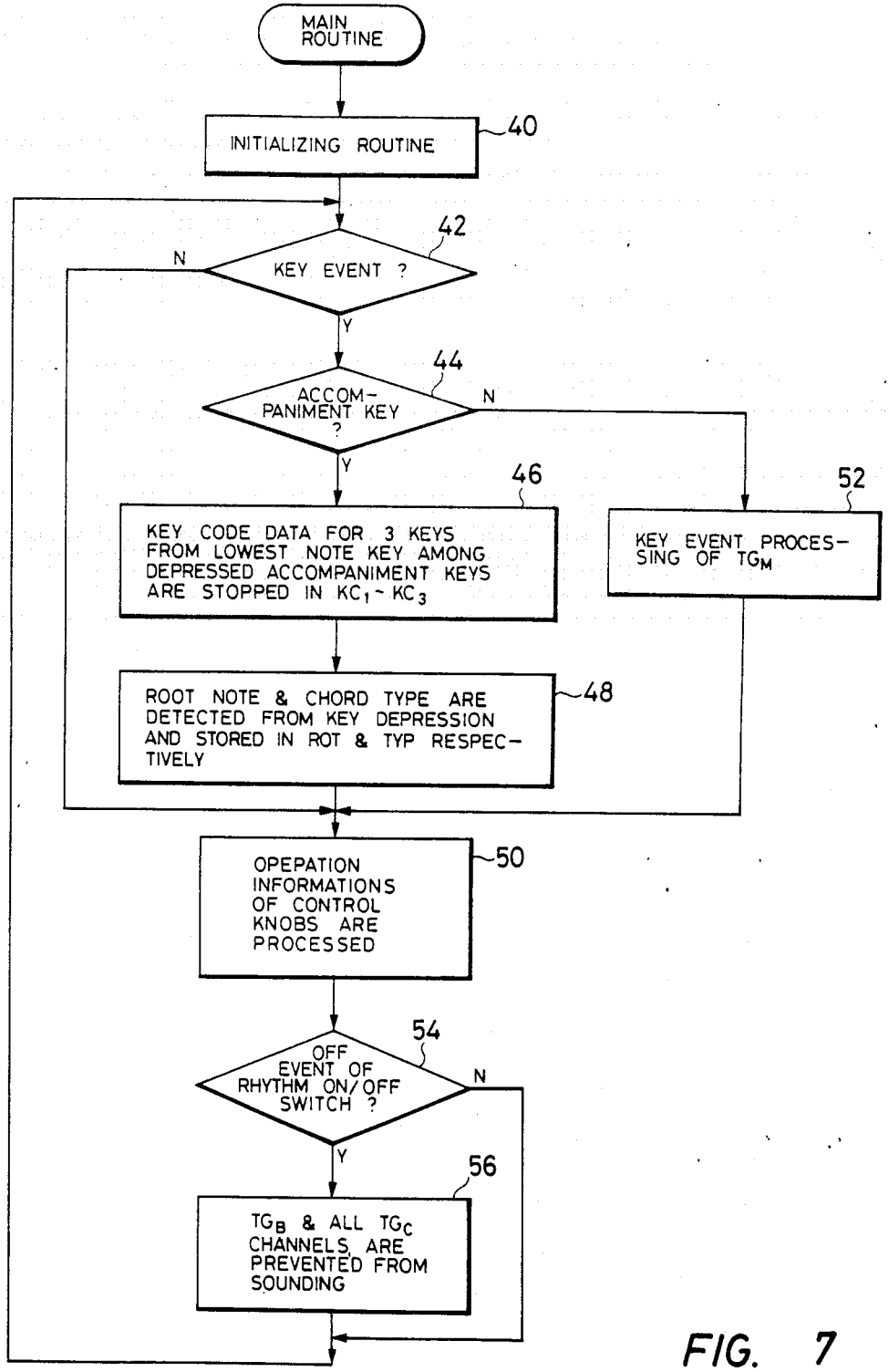
FIG. 7 is a block diagram showing the flow chart of the main routine processing.

Next, the main routine processing will be described by referring to FIG. 7.

In Step 40 to begin with, an initializing routine is carried out to perform initial setting of various registers and so forth. And, processing moves onto the Step 42, wherein judgment is made whether or not there is present a key event (i.e. "on" or "off" operation of a key) in the keyboard which is included in the keyboard circuit 12. If the result of this judgment indicates the presence of a key event (Y), processing moves onto Step 44.

In Step 44, judgment is made whether or not the key event has occurred on an accompaniment key (a key in the accompaniment keyboard region) and if this is an accompaniment key (Y), processing moves onto Step 46.

In Step 46, key code data for three (3) keys counted from the lowest note key among the accompaniment keys being depressed are stored in the registers $KC_1$~$KC_3$. In this case, if the number of the depressed keys is two or less, those registers among $KC_1$~$KC_3$ which remain empty in data will store such data that all of the eight bits invariably indicate "1". Such data that all of their eight (8) bits are invariably "1" represent the absence of pronunciation.

Next, in Step 48, detection is made of a root note and a chord type from the key-depression state. The root note datum is stored in the register ROT, while the chord type datum is stored in the register TYP. And, the processing moves onto Step 50.

Now, in the judgment made in Step 44, if the result of the detection indicates that there has been no accompaniment key that has been depressed (N), this means that there has been a key event in the keyboard region for melody performance. Therefore, processing advances to Step 52 to carry out a key event processing of the melody tone generator section $TG_M$. For example, if this key event corresponds to a "key-on" (key depression), there is formed in the melody tone generator section $TG_M$ a melody tone signal corresponding to the depressed key. In response thereto, a melody tone is sounded out from the loudspeaker 34. Upon completion of Step 52, processing advances onto Step 50. It should be understood here that, even in case the judgment in Step 42 indicates no key event (N), processing will move onto Step 50.

In Step 50, operation information processing of various kinds of control knobs is performed. That is, control knob operation informations are detected for each control knob, and in case there is a control knob operation information which differs from the previous information, the contents of such a new information are written in the corresponding register. Thanks to this processing, the setting of tone color, tone volume, effect and so forth as well as the control or determination of rhythm selection, rhythm start and like controls become feasible.

Next, in Step 54, judgment is made whether or not there is an "off" event of the rhythm on-off switch. If the result indicates the presence of an "off" event (Y), processing moves to Step 56, wherein all of the tone-producting channels of the chord tone generator section $TG_C$ and the bass tone generator section $TG_B$ are caused to cease sounding of tones. With this, processing moves back to Step 42, and those kinds of processing as mentioned above are repeated. It should be noted here that, even in case the judgment in Step 54 indicates no "off" event (N), processing returns to Step 42.

TEMPO INTERRUPTION ROUTINE (FIG. 8)

Next, referring to FIG. 8, description will be made of the tempo interruption routine which is intended for the generation of chord tones, bass tones and rhythm tones. This routine is carried out for each generation of a tempo clock pulse TP from the frequency divider 26.

In Step 60 to begin with, judgment is made whether or not there is given a rhythm start command by the rhythm on-off switch, i.e. whether or not a rhythm is running. If the result of this judgment indicates "running"0 (Y), processing moves onto Step 62.

In Step 62, a rhythm tone processing is carried out based on the count value of the tempo counter TCLA. This processing is intended to control or determine the generation of the rhythm tones produced from the rhythm tone generator section $TG_R$ by the use of the rhythm pattern corresponding to the selected type of rhythm. More particularly, among the group of rhythm determination data constituting rhythm patterns, there is read out, from the pattern memory 22, a specific rhythm determination datum corresponding to the value of TCLA. In case this datum thus read out indicates that a tone or tones of either a single or a plurality of percussion instruments is or are to be sounded out, the corresponding percussion instrument tone source included in the rhythm tone generator section $TG_R$ is driven to generate a tone signal of either a single or a plurality of percussion instrument or instruments. By repeating such processing as mentioned above for each tempo interruption, there is performed a rhythm performance automatically in accordance with the selected rhythm pattern. Subsequent to Step 62, processing moves onto Step 64.

In Step 64, whether the TCLA value can be divided by "8" is checked, to thereby judge whether the timing is that of a 4-th note timing. If the result of this judgment is affirmative (Y), processing moves onto Step 66, and the count value of the one-bit counter 28 is written in the register CNT. And, processing advances to Step 68. It should be noted here that, if the result of judgment in Step 64 is negative (N), processing moves onto Step 68 without passing through Step 66.

In Step 68, whether the TCLA value is "0" or an "even number" is checked to thereby judge whether the timing is that of 16-th note timing. If the result of this judgment is affirmative (Y), the bass tone processing sub-routine in Step 70 is carried out first, and thereafter processing moves onto Step 72. If, however, the result of judgment is negative (N), a chord tone processing sub-routine in Step 72 is carried out without going through Step 70. In other words, the bass tone processing in Step 70 is carried out for each 16th-note timing, while the chord tone processing in Step 72 is carried out for each 32nd-note timing. It should be noted here that, with respect to the sub-routines in Steps 70 and 72, their description will be made later by referring to FIGS. 11 and 9, respectively.

Subsequent to Step 72, processing advances to Step 74, wherein the count value of TCLA is upped by "one", and processing moves onto Step 76.

In Step 76, checking is made whether or not the TCLA value indicates "32" to thereby judge whether or not a single bar (measure) has ended. If the result of this judgment indicates the end of one bar (Y), TCLA is reset to "0" in Step 78, and thereafter processing returns to the main routine. Also, in case one bar has not ended yet (N), processing returns to the main routine without passing through Step 78.

In case, however, the judgment in Step 60 indicates that the rhythm is not running (N), TCLA is reset to "0" in Step 80, and thereafter processing moves back to the main routine.

Figure 9:
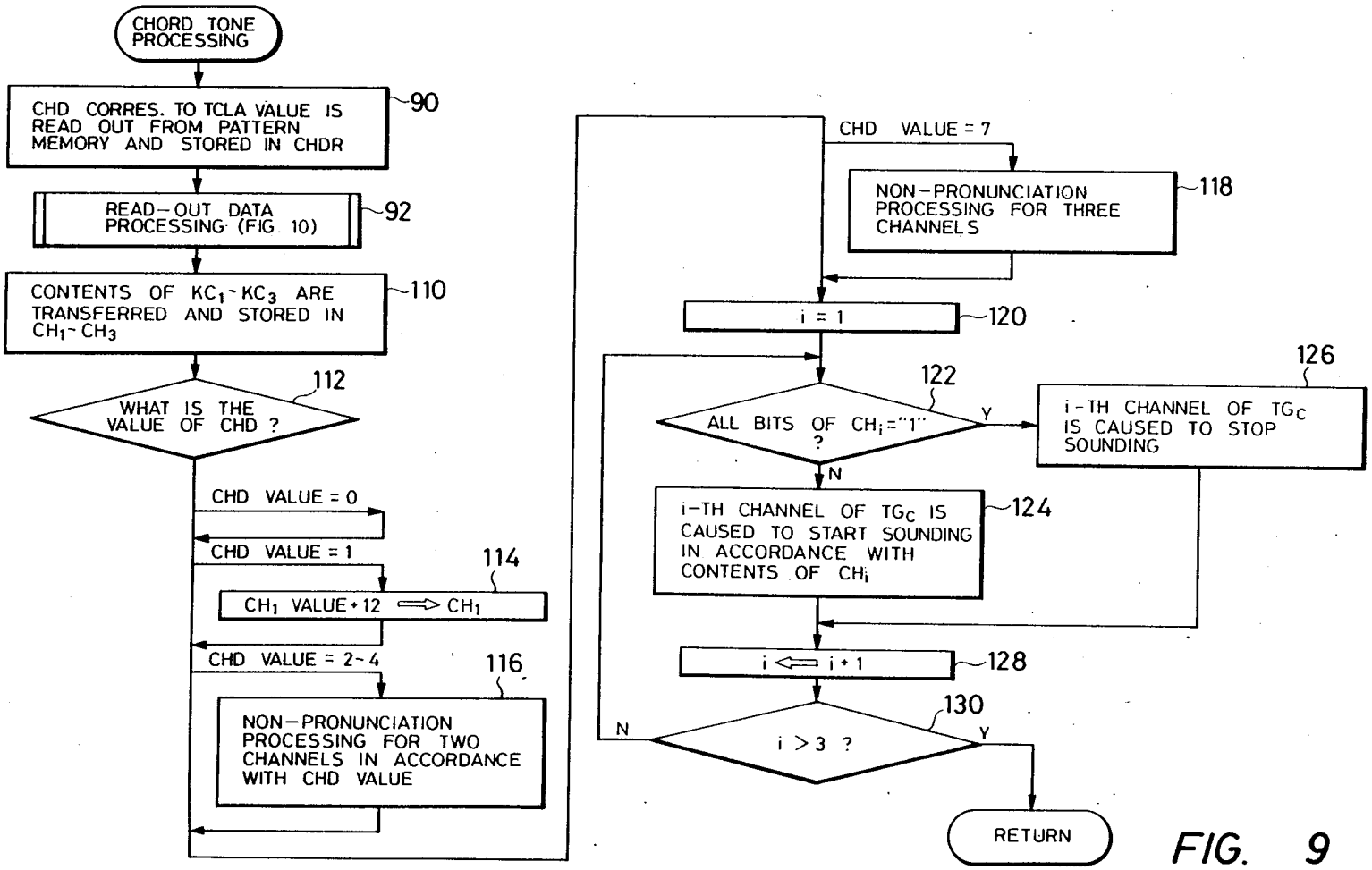
FIG. 9 is a block diagram showing the flow chart of the chord tone processing sub-routine.
Figure 10:
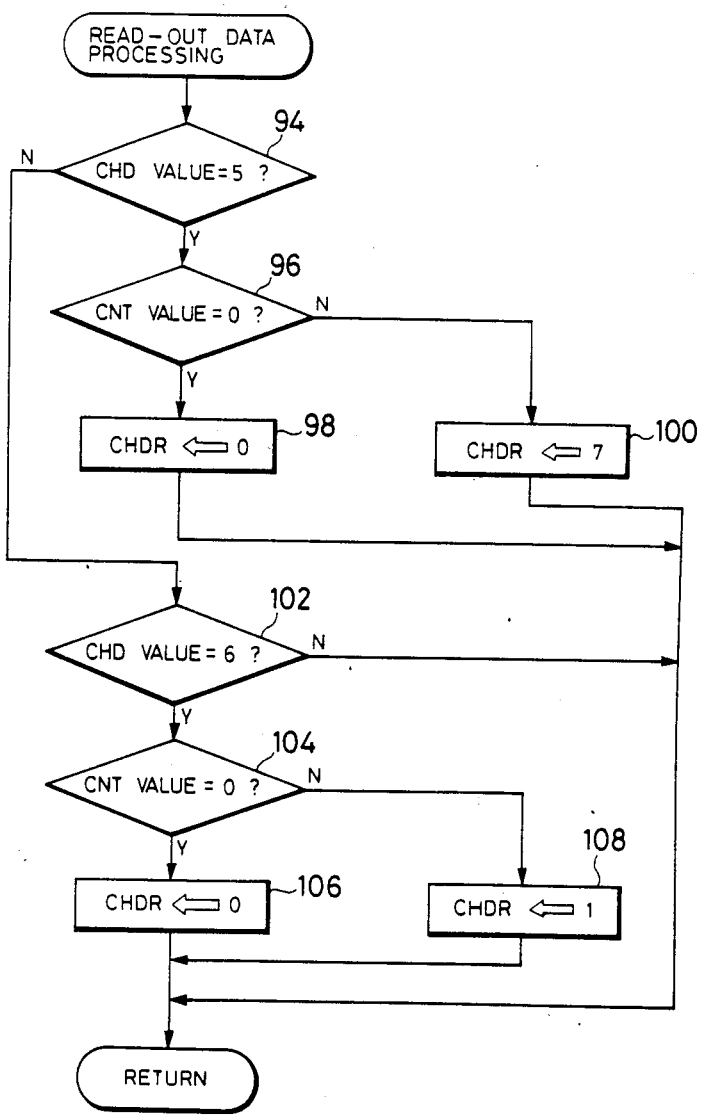
FIG. 10 is a block diagram showing the flow chart of the read-out data processing sub-routine.

CHORD TONE PROCESSING SUB-ROUTINE (FIGS. 9 and 10)

Next, chord tone processing sub-routine will be described by referring to FIGS. 9 and 10.

In Step 90 to begin with, a chord determination datum CHD corresponding to the TCLA value is read out from the pattern memory 22, and this datum is stored in the register CHDR. And, processing moves to Step 92, wherein the read-out datum processing sub-routine of FIG. 10 is carried out.

In FIG. 10, judgment is made in Step 94 as to whether or not the CHD value of the register CHDR is "5". If the result of this judgment is affirmative (Y), processing moves over to Step 96, wherein the value of the register CNT is judged to be "0" or not.

In case the result of judgment in Step 96 is affirmative (Y), the register CHDR is set to "0" in Step 98. If the result of judgment is negative (N), "7" is written in the register CHDR in Step 100. More specifically, if the CNT value indicates "0", the chord determination datum CHD will become "0" to express that all of the three tones require to be sounded out jointly. If the CNT value is "1", the chord determination datum CHD becomes "7" and this will represent that all of the tones require to stop their sounding-out. Subsequent to Step 98 or 100, processing will return to the routine shown in FIG. 9.

On the other hand, in case the judgment in Step 94 does not indicate "5" (N), processing moves onto Step 102. In this Step 102, judgment is made whether the CHD value of the register CHDR indicates "6", and if its result is negative (N), this will means that the CHD value is either one of "0"~"4" or "7", and the processing will return to the routine of FIG. 9. Also, if the result of the judgment made then is affirmative (Y), processing moves onto Step 104, and judgment is made whether the value of the register CNT is "0" or not.

If the result of the judgment made in Step 104 is noted to be affirmative (Y), "0" is written in the register CHDR is Step 106. If, on the other hand, the result of said judgment is negative (N), "1" is written in the register CHDR in Step 108. More particularly, if the CNT value is "0", this will bring the chord determination datum CHD to "0" to represent that all of the three tones require to be pronounced. If the CNT value is "1", the chord determination datum is rendered to "1", representing that the lowest pitch note among the three notes of the chord is upped by one octave and the resulting three notes are to be sounded out. Subsequent to either Step 106 or 108, processing will return to the routine shown in FIG. 9.

According to the sub-routine of FIG. 10, it will be noted that, by preliminarily setting the value of the chord determination datum to either "5" or "6", the contents of control, i.e. determination, of this datum CHD are randomly determined in accordance with the CNT value (count value of the counter 28), and thus it becomes possible that generation of chord tones can be made rich in variation.

Referring now to FIG. 9, Step 92 is followed by Step 110, wherein, the key code data stored in the registers $KC_1 \sim KC_3$ are transferred to registers $CH_1 \sim CH_3$, respectively, and they are stored therein. With this, processing moves to Step 112.

In Step 112, judgment is made what value the CHD datum of the register CHDR has. There could be the following four (4) instances in the result of this judgment. They are: CHD value="0"; CHD value="1"; CHD value="2"~"4"; and CHD value="7".

When CHD value="0", no processing is carried out, and processing moves to Step 120.

In case of CHD value="1","12" is added in Step 114 to the value of the register $CH_1$ corresponding to the lowest note, and the resulting summed-up value is written in the register $CH_1$. As a result, the tone pitch of the lowest note has not been set to one-octave higher. Thereafter, processing moves to Step 120.

In case of CHD value="2"~"4", there is carried out in Step 116 a non-tone pronouncing processing for two channels in accordance with the CHD value which is presented then. More specifically, in case of CHD value="2", a datum that all of the 8 bits are invariably "1" is stored in the registers $CH_2$ and $CH_3$ excluding the register $CH_1$. Also, in case of CHD="3", datum that all of the 8 bits are invariably "1" is stored in the registers $CH_1$ and $CH_3$, respectively, excluding the register $CH_2$. Furthermore, in case CHD value="4", a datum that all of the 8 bits are ivariably "1" is written in the registers $CH_1$ and $CH_2$ excluding the register $CH_3$. As a result, in case the CHD value is "2", only the lowest note based on the register $CH_1$ becomes pronounceable; and in case the CHD value is "3", only the middle note based on the register $CH_2$ can become pronounceable; and when the CHD value is "4", only the highest pitch note can become pronounceable based on the value of $CH_3$. Thereafter, processing moves onto Step 120.

In caes CHD value="7", non-tone pronouncing processing for the three (3) channels is carried out in Step 118. That is, a datum that all of the eight bits are invariably "1" is stored in each of the registers $CH_1 \sim CH_3$. With this, processing advances to Step 120.

In Step 120, "1" is written for the channel which is designated as being a channel "i". And, processing moves onto Step 122, wherein judgment is made whether or not all of the bits of the register $CH_i$ are invariably "1". If the result of this judgment indicates that all bits do not indicate "1" (N), processing moves to Step 124.

In Step 124, the "i"-th channel of the chord tone generator section $TG_C$ is caused to start generation of tones in accordance with the contents of the register $CH_i$. If, for example, "i"="1", it should be noted that, in the first channel, there is formed a signal of the lowest note among the three notes based on the datum of the register $CH_1$, and in accordance therewith the lowest note tone is sounded out from the loudspeaker 34.

On the other hand, if the judgment made in Step 122 indicates that all bits indicate "1" (Y), processing advances to Step 126. In this Step 126, the "i"-th channel of the chord tone generator section $TG_C$ is caused to stop pronunciation of tones.

Subsequent to Step 124 or 126, the channel number "i" is upped by "one" in Step 128, and then processing moves to Step 130, wherein judgment is made whether or not "i">"3". If the result of this judgment does not indicate "i">"3" (N), those kinds of processing of Step 122 and onwards will be repeated until "i">"3" is gained. As a result, commencement of pronunciation for the three (3) channels and/or the stopping of pronunciation can be controlled. And, if "i">"3" is judged (Y) in Step 130, processing will return to the routine of FIG. 8.

Figure 11:
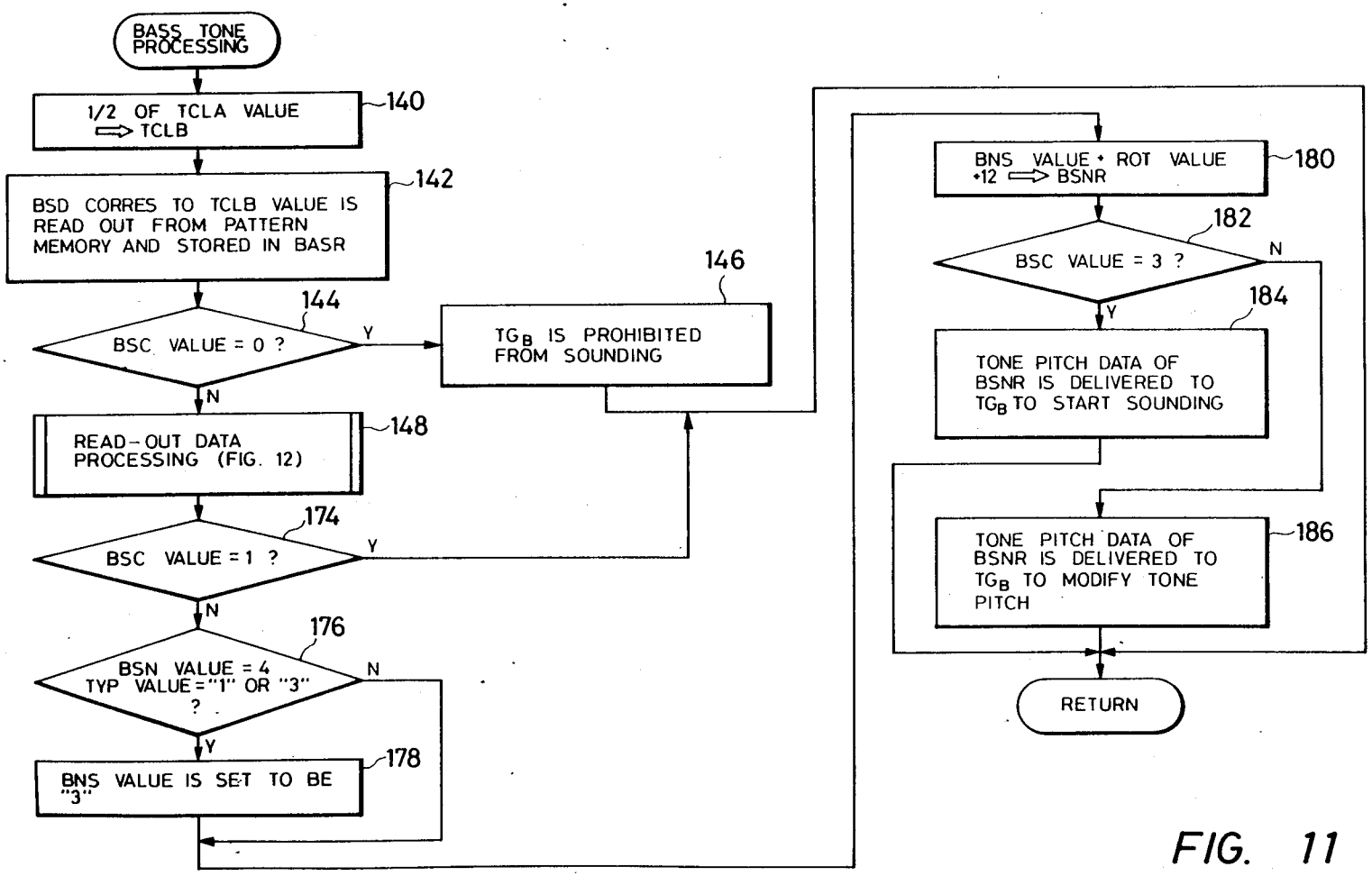
FIG. 11 is a block diagram showing the flow chart of the bass tone processing sub-routine.
Figure 12:
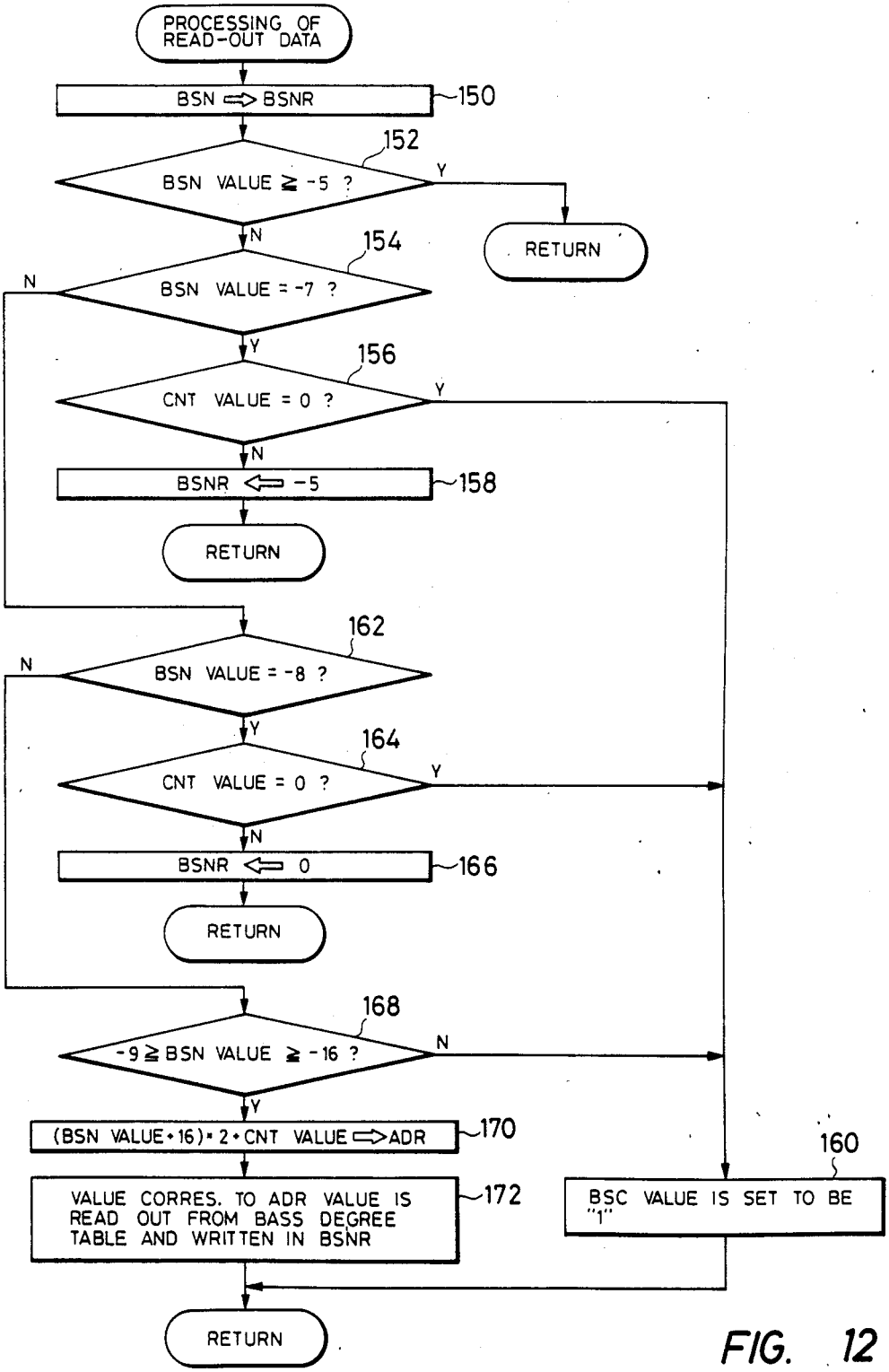
FIG. 12 is a block diagram showing the flow chart of the read-out data processing sub-routine.

BASS TONE PROCESSING SUB-ROUTINE (FIGS. 11 and 12)

Next, by referring to FIGS. 11 and 12, bass tone processing sub-routine will be described.

Firstly, in Step 140, a value which is ½ of the count value of the tempo counter TCLA is written in the tempo counter TCLB. And, processing moves to Step 142, wherein a bass determination datum BSD corresponding to the TCLB value is read out from the pattern memory 22, and this datum BSD is stored in the register BASR. Thereafter, processing moves to Step 144.

In Step 144, judgment is made whether the value of the bass tone determination datum BSC among those bass determination data of the register BASR is indicateas "0" or not. If the result of this judgment indicates a affirmative (Y), the bass tone generator section $TG_B$ is rendered to a cease of pronunciation in Step 146, and then processing returns to the routine of FIG. 8. Also, if the result of judgment in Step 144 is negative (N), this means that the BSC value is either one of "1"~"3", so that processing moves to Step 148. In this Step 148, the reading-out data processing sub-routine of FIG. 12 is carried out.

In FIG. 12, it should be noted that, in Step 150, processing is made so that, among those bass determination data BSD of the register BASR, the bass tone pitch determination datum BSN is transferred to the register BSNR and it is stored therein. And, processing moves to Step 152, wherein judgment is made whether the value of the datum BSN of the register BSNR is greater than "−5". If the result of this judgment is affirmative (Y), such a determination contents setting processing as will be described below is not carried out, and processing returns to the routine of FIG. 11.

In case the result of judgment in Step 152 is negative (N), this means that the BSN value is either one of "−16"~"−6", so that the determination contents setting processing of Step 154 and onwards is carried out. More specifically, in Step 154, judgment is made whether the datum BSN value of the register BSNR is "−7", and if the result of this judgment is affirmative (Y), processing will move onto Step 156.

In Step 156, judgment is made whether or not the value of the register CNT is "0". If the result of this judgment is negative (N), this means that the CNT value is "1", and processing moves to Step 158. In this Step 158, "−5" is written in the register BSNR. As a result, the datum BSN of the register BSNR will indicate the octave-lower 5-th degree which has been lowered by one octave from the 5-th degree note. Thereafter, processing moves back to the routine of FIG. 11. Also, when the judgment in Step 156 indicates that CNT value="0", processing moves onto Step 160, wherein the value of the bass pronunciation determination datum BSC of the register BASR is set to "1". As a result, the bass pronunciation determination datum BSC will indicate continuation of pronunciation (i.e. continuation of the sounding tone at the same tone pitch). Thereafter, processing returns to the routine of FIG. 11.

In case the BSN value is judged to be not "−7" (N) in Step 154, processing moves to Step 162. In this Step 162, judgment is made whether the value of the datum BSN of the register BSNR is "−8" or not, and if the result of this judgment is affirmative (Y), processing moves to Step 164.

In Step 164, similarly as described above, judgment is made whether the CNT value is "0". If it is "0" (Y), "1" is written as the BSC value in Step 160, and then processing returns to the routine of FIG. 11. Also, if the value is not "0", (N), processing moves to Step 166, wherein "0" is written in the register BSNR. As a result, the datum BSN of the register BSNR will indicate a note to be the first degree or unison (i.e. the same note), and thereafter pórcessing returns to the routine of FIG. 11.

In case, in the judgment in Step 162, the BSN value is not found to be "−8" (N), processing moves onto Step 168. In this Step 168, judgment is made whether the value of the datum BSN of the register BSNR falls in the range of "−16" or thereabove and "−9" or therebelow. If the result of this judgment is negative (N), this means that the BSN value is "−6". Thereafter, in a manner similar to that described above, "1" is written as the value of BSC in Step 160, and thereafter the processing returns to the routine of FIG. 11. On the other hand, if the result of judgment in Step 168 is affirmative (Y), this means that the BSN value is either one of "−16"~"−9", so that processing advances to Step 170.

In Step 170, there is formed an address datum for reading the bass note degree table of the pattern memory 22, and this address datum is stored in the register ADR. Informing the address datum, such a mathematical calculation as "(BSN value+16)×2+CNT value" is conducted. Here the reason for adding "16" to the BSN value is to convert the value "−16"~"−9" to a value "0"~"7". By doubling the respective converted values, there are obtained such values as "0", "2", "4", . . . , "14". And, by adding a CNT value of either "0" or "1" to those values mentioned above, there are obtained ADR values "0"~"15" as have been shown in Table 2. Accordingly, by acquiring a specific BSN value (either one of "−16"~"−9") and a specific CNT value (either "0" or "1"), there will be determined a specific ADR value (either one of "0"~"15") in accordance with the acquired values mentioned above.

Next, in Step 172, in accordance with the regisered ADR value in Step 170, a corresponding stored value is read out from the bass note degree table, and this value is written in the register BSNR. As a result, the datum BSN of the register BSNR will indicate the note degree corresponding to the read-out value which has been stored. Thereafter, processing returns to the routine of FIG. 11.

According to the sub-routine of FIG. 12, it should be noted that, by preliminarily setting the value of the bass tone pitch determination datum BSN to either one of "−16"~"−7", the contents of determination of this datum BSN is determined in random fashion in accordance with the CNT value (i.e. the count value of the counter 28), whereby enabling the bass tone generation to become rich in variation.

In FIG. 11, subsequent to Step 148, processing moves to Step 174. In this Step 174, judgment is made whether the BSC value of the register BASR is "1", and if it is "1" (Y), processing returns to the routine of FIG. 8. As a result, the bass tones which are being sounded out will continue pronunciation with the same tone pitches.

In case the judgment in Step 174 gives the result that the BSC value is not "1" (N), this means that the BSC value is either "2" or "3", so that processing moves to Step 176. In this Step 176, judgment is made whether the BSN value of the register BSNR is "4" and also whether the value of the chord type datum of the register TYP is either "1" or "3". Here, it should be noted that the fact that the BSN value is "4" signifies that the note is of the third degree, while the fact that the TYP value is either "1" or "3" signifies the chord type to be in the minor category (minor or minor seventh).

If the result of judgment made in Step 176 is affirmative (Y), processing moves to Step 178, wherein "3" as the BSN value is written in the register BSNR. As a result, the note scale degree has now been lowered by one as the number of semitone. Thereafter, processing moves to Step 180. Also, if the result of judgment in Step 176 is negative (N), processing advances to Step 180 without going through Step 178.

In Step 180, a bass tone pitch determination processing is carried out.

More specifically, a bass tone pitch datum is formed by adding "12" to the sum of the BSN value (note degree) of the register BSNR and the value (tone pitch of root note) of the register ROT, and the resulting datum is written in the register BSNR. And, processing moves onto Step 182.

In Step 182, judgment is made whether or not the BSC value of the register BASR is "3", and if it is "3" (Y), processing moves to Step 184. In this Step 184, the bass tone pitch datum of the register BSNR is delivered out to the bass tone generator section $TG_B$, and corresponding bass tone is caused to start its pronunciation. In case the result of judgment in Step 182 is negative (N), this means that the BSN value is "2", and processing moves to Step 186. In Step 186, the bass tone pitch datum of the register BSNR is delivered out to the bass tone generator section $TG_B$, wherein the tone pitch of the bass tone which is being sounded out is altered to the pitch corresponding to said datum.

Figure 8:
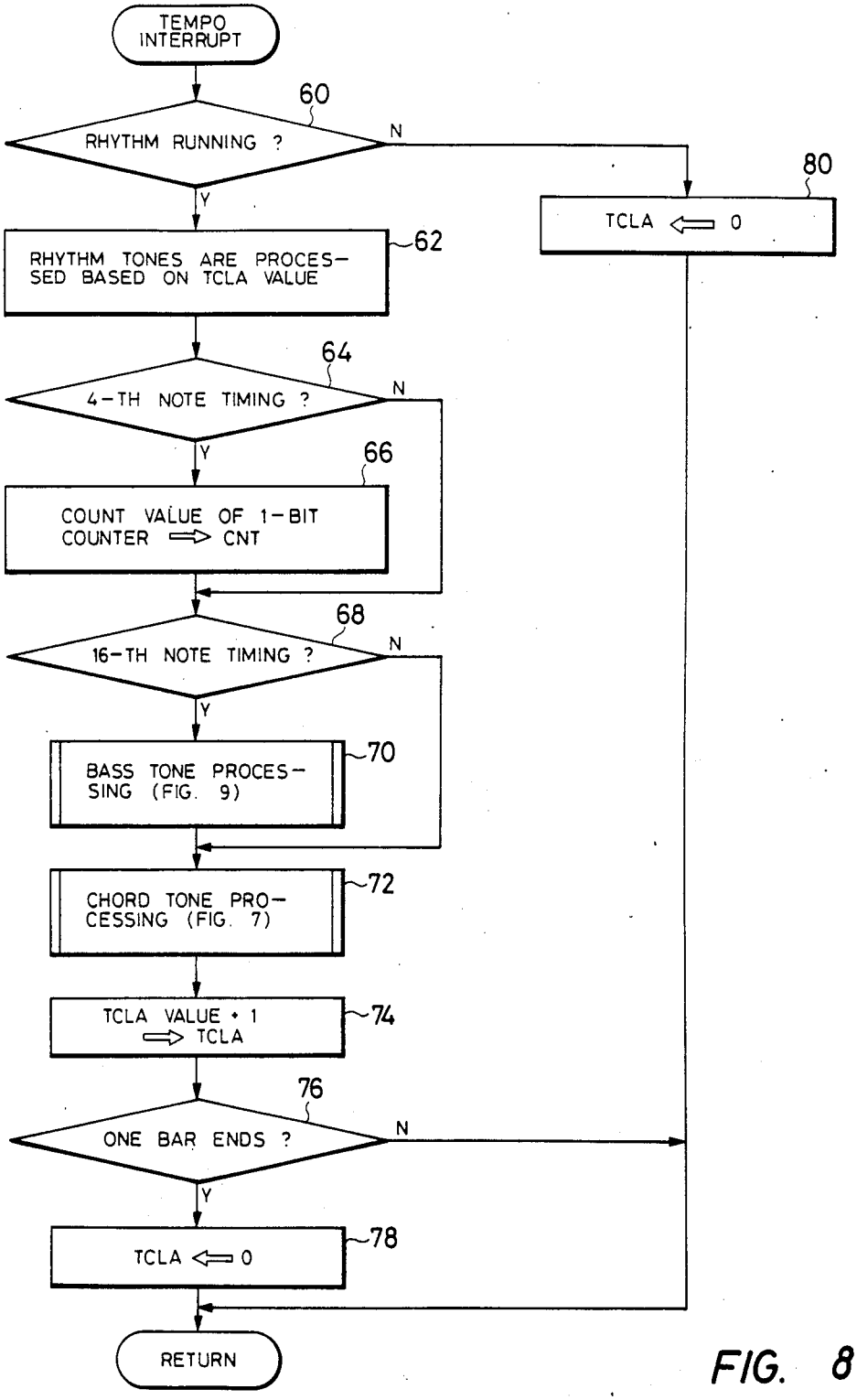
FIG. 8 is a block diagram showing the flow chart of the tempo interrupt routine processing.

Subsequent to Step 184 or 186, processing returns to the routine of FIG. 8.

MODIFIED EMBODIMENTS

The present invention is not limited to the embodiment described above. It is possible to put this invention to practice by modifying the present invention to such one as described in items (1)~(5) given below.

(1) In order to determine the data which are to be written in the registers $KC_1$~$KC_3$, the system (finger chord type) wherein the data are determine by depression of chord keys as performed in the preceding embodiment may be replaced by the system (single finger type) that the data are determined in accordance with the number of keys (natural keys or sharp keys) which are depressed. In this latter system, if the keys are of the major category or in the minor category, it is only necessary to write the data of 1°, 3° and 5° notes in the $KC_1 \sim KC_3$ while if the keys are in the seventh category, the data of 1°, 3° and 7° notes are written in the registers $KC_1 \sim KC_3$.

(2) Such accompaniment patterns as chord pattern, bass pattern and like patterns are such that not only they are stored for each rhythm pattern, but by arranging so that even for a same rhythm pattern, a different accompaniment pattern for each different chord type is stored, whereby making the accompaniment richer in variation.

(3) The timing at which the count value of the one-bit counter 28 is not limited to each 4-th note timing as mentioned in the preceding embodiment, but it may be a timing corresponding to any other length note timings or for each occurrence of interruption, or like timings.

(4) The manner of generation of chord tones at respective timings is not limited to those mentioned in the preceding embodiment, but the manner may be such that two tone among the three tones are generated, or that the tone pitches may be altered.

(5) With respect to the chord patterns and bass patterns and like accompaniment patterns have been described in the preceding embodiment so as to store a length corresponding to one bar (measure). By arranging so that accompaniment patterns for a plurality of bars are stored, an accompaniment much richer in variation becomes feasible.

As described above, according to the present invention, arrangement is provided so that an accompaniment pattern is controlled so as to be partially modified or altered in a random fashion. Thus, monotonousness noted in the utilizing of a pattern can be eliminated, and thus an automatic accompaniment rich in variation becomes possible. Also, the present invention is not designed to increase the number of accompaniment patterns, there can be used a pattern memory having a relatively small capacity. Furthermore, since the accompaniment pattern as a whole is not modified or altered, there is no need to make pattern selecting operations on the panel face by the user.

What is claimed is:

1. An electronic musical instrument performing automatic accompaniment on memorized patterns, comprising:

memory means storing a set of sequentially aligned accompaniment data constituting an accompaniment pattern;

reading-out means connected to said memory means to successively read out, at given pulse timings, said accompaniment data from said memory means;

judging means connected to said reading-out means to judge, at each time said accompaniment data are read out, whether each of said data indicates a specific value;

random signal generating means successively generating output signals independently of the accompaniment data reading-out timings and in different values with time for each output signal;

accompaniment data contents determining means connected to said judging means and to said random signal generating means to determine the contents of the accompaniment data which can differ depending on the value of the signal outputted from said random signal generator just when the read-out accompaniment data indicates a predetermined specific value;

accompaniment tone generation control means connected to all of said reading-out means, said judging means and said contents determining means to be able to determine the generation of accompaniment tones in accordance with the read-out accompaniment data not judged as indicating a specific value, and also to be able to determine the generation of accompaniment tones based on the accompaniment data supplied from said contents determining means when the read-out accompaniment data is judged as indicating a specific value; and an accompaniment keyboard connected to said accompaniment tone generation control means to control generation of accompaniment tone as instructed by said control means based on a key depression information supplied from said keyboard.

2. An electronic musical instrument according to claim 1, in which:

said contents determining means is arranged to be capable of determining the contents of the accompaniment pattern in accordance with the value of the accompaniment data judged to indicate said specific value, and also with a value of the random signal outputted from said random signal generating means.

* * * * *